US005145115A

United States Patent [19]

Denton

[11] Patent Number: 5,145,115

[45] Date of Patent: Sep. 8, 1992

[54] AEROSOL DISPERSER ASSEMBLY

[76] Inventor: Eugene B. Denton, 5540 W. Ontario Ave., Littleton, Colo. 80123

[21] Appl. No.: 703,890

[22] Filed: May 22, 1991

[51] Int. Cl.[5] ..... B05B 3/04; B05B 3/10

[52] U.S. Cl. ..... 239/222.17; 239/381; 222/402.14

[58] Field of Search ..... 239/222.17, 222.11, 239/222, 223, 224, 340, 381, 337; 222/402.14

[56] References Cited

U.S. PATENT DOCUMENTS

| | | | |
|---|---|---|---|
| 3,823,849 | 7/1974 | Ruscitti | 222/96 |
| 3,870,014 | 3/1975 | Buck | 118/52 |
| 4,239,158 | 12/1980 | Gates | 222/402.14 |
| 4,440,325 | 4/1984 | Treuhaft et al. | 222/402.14 |
| 4,568,002 | 2/1986 | Weinstein et al. | 222/402.14 |
| 4,627,430 | 12/1986 | Klimt | 128/200 |
| 4,680,173 | 7/1987 | Burger | 424/47 |
| 4,742,963 | 5/1988 | Marvaldi | 239/337 |
| 4,765,347 | 8/1988 | Sensabaugh, Jr. et al. | 131/273 |
| 4,781,312 | 11/1988 | Strazdins | 222/309 |
| 4,805,839 | 2/1989 | Malek | 239/337 |
| 4,838,459 | 6/1989 | Nitta | 222/136 |
| 4,863,073 | 9/1989 | Burt et al. | 222/402.2 |

*Primary Examiner*—Andres Kashnikow
*Assistant Examiner*—Karen B. Merritt
*Attorney, Agent, or Firm*—Cesari and McKenna

[57] ABSTRACT

An omnidirectional disperser assembly for use with aerosol containers. A rotatable disperser is disposed on a support which frictionally engages the top of an aerosol container. An opening in the support allows spray released from the container's spray button to pass through. When a trigger is actuated, spray is released which impinges on the disperser and imparts a rotational force. As a result, the disperser rotates and directs the spray in a substantially uniform, omnidirectional manner.

16 Claims, 3 Drawing Sheets

AEROSOL DISPERSER ASSEMBLY

BACKGROUND OF THE INVENTION

1. Field of the Invention

The present invention relates generally to the field of aerosol containers and, more particularly, to a spray disperser for use with an aerosol can.

2. Discussion of the Prior Art

Conventional aerosol containers for the consumer market are typically manufactured with a simple "spray button" mounted on the top of the container. To dispense the contents of the container, a user presses down on the spray button and a stream of product is released through a pinhole in the side of the button.

For some applications, however, the conventional spray button presents a significant disadvantage. Specifically, because the spray button directs the stream in a single direction, it does not perform well with products which are intended to be dispersed over a wide area or throughout a space. For example, one may wish to disperse an air freshener product uniformly throughout the interior of a vehicle or an insecticide throughout a room.

SUMMARY OF THE INVENTION

In brief summary, the present invention provides an inexpensive assembly for dispersing an aerosol product in a substantially uniform manner over a wide area or in an enclosed space. The assembly is compatible with standard aerosol cans whose tops include a spray button surrounded by a raised ring that is conventionally used to secure a cap.

The assembly comprises a base or support, a rotatable disperser and a trigger. The support is adapted to frictionally engage the raised ring on the top of the aerosol can and includes a slot which is aligned with the pin hole in the spray button to allow spray to pass through. The support provides a bearing surface on which the disperser rests, as well as a hub about which the disperse may rotate.

The disperser comprises a generally annular member having a cupped top surface from which a plurality of integral fins or vanes upwardly extend. Around the central opening of the member there are narrow spaces between adjacent fins, which spaces allow spray exiting from the slot in the support to pass outwardly between the fins.

The trigger is mounted in the top of the support and is adapted to mechanically couple to the spray button. Trigger stops disposed within the support provide tactile feedback to the user to indicate when the trigger has reached a position corresponding to a maximum aerosol release rate.

When the trigger is activated, the spray button is depressed and aerosol spray is released. The spray passes through the slot in the support and impinges on the sides of the fins and cupped top surface of the disperser. The cupped surface, in combination with the shape and arrangement of the fins, tends to force the spray outward and slightly upward while also imparting a rotational force to the disperser. Consequently, the disperser begins to rotate and direct the spray in a substantially uniform, omnidirectional manner without any motor or external power supply.

The disperser assembly is easily and quickly removed in the event a user wishes to operate the aerosol can in a conventional manner using the spray button and, conversely, is also easily reinstalled.

BRIEF DESCRIPTION OF THE DRAWINGS

This invention is pointed out with particularity in the appended claims. The above and further advantages of this invention may be better understood by referring to the following description taken in conjunction with the accompanying drawings, in which:

DETAILED DESCRIPTION OF AN ILLUSTRATIVE EMBODIMENT

Figure 1:
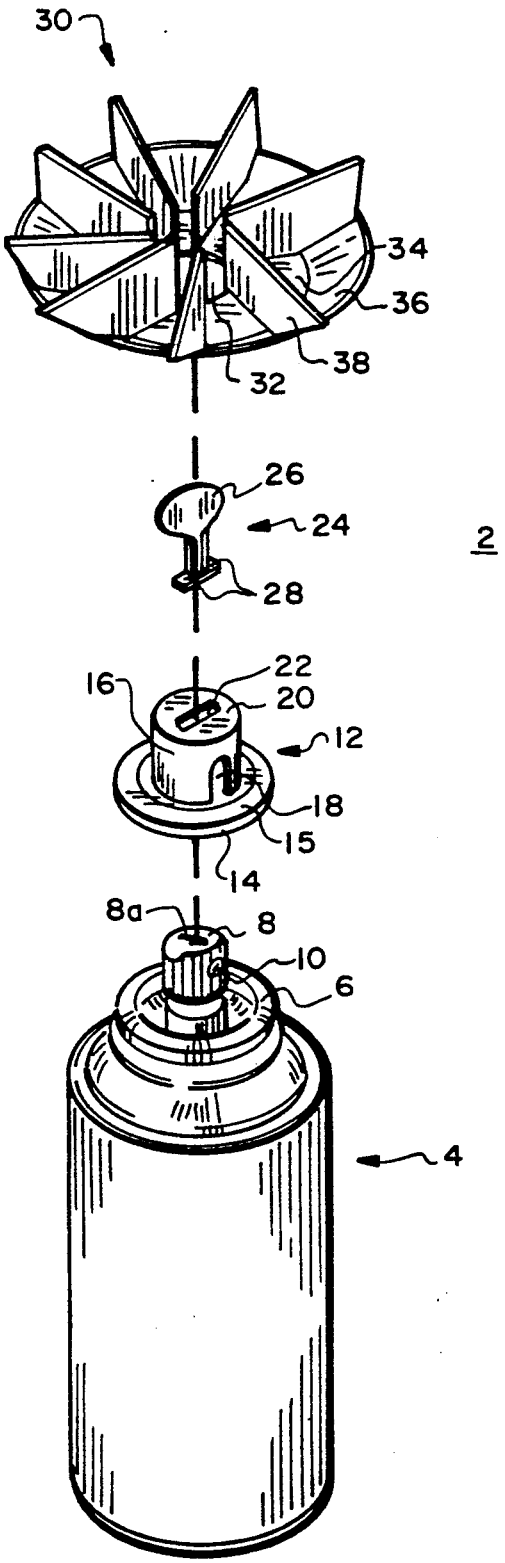
FIG. 1 is a perspective, exploded view of an aerosol disperser assembly constructed in accordance with the preferred embodiment of the present invention.

FIG. 1 shows a system 2 for dispersing an aerosol product in a generally uniform, omnidirectional manner. An aerosol container 4 includes a raised metal ring 6 on its top. The ring 6 surrounds a spray button 8 in which a pinhole 10 is disposed. The ring 6 is conventionally used for securing a removable cap over the spray button 8. The top surface 8*a* of the spray button 8 is slightly concave and may include a series of ridges or grooves intended to prevent slippage during use.

A support member 12 includes a lower portion 14 whose bottom surface is recessed and dimensioned to frictionally engage the ring 6. The lower portion 14 provides an annular bearing surface 15, whose functions are described in detail below.

The support member 12 also includes an upper portion 16 which is hollow and dimensioned to accommodate the spray button 8. An opening or slot 18 disposed in the side of the upper portion 16 is substantially aligned with the pinhole 10 when the support member 12 is engaged with the container 4. A top surface 20 of the upper portion 16 includes a slot 22 for receiving a trigger 24.

The trigger 24 includes a flattened first end 26 which protrudes from the top of the member 12 when the trigger is inserted in the slot 22. The other end of the trigger 24 includes two integral lateral extensions 28. The extensions 28 are dimensioned so that they clear the slot 22 when the trigger 24 is inserted therein.

A rotatable disperser 30 having a generally annular shape includes a central opening 32 which is dimensioned to allow the disperser to slide over the trigger 24 and onto the upper portion 16. The base of the disperser 30 includes a substantially flat inner portion 34 and a sloped outer portion 36. A plurality of integral fins or vanes 38 extend upwardly from the base. When the disperser 30 is placed onto the support member 12, the bottom of the flat inner portion 34 rests on the bearing surface 15.

The support member 12, trigger 24 and disperser 30 are readily manufacturable from inexpensive, commercially available materials. A plastic material is preferably used due to its low cost, light weight and resistance to corrosion.

Figure 2A:
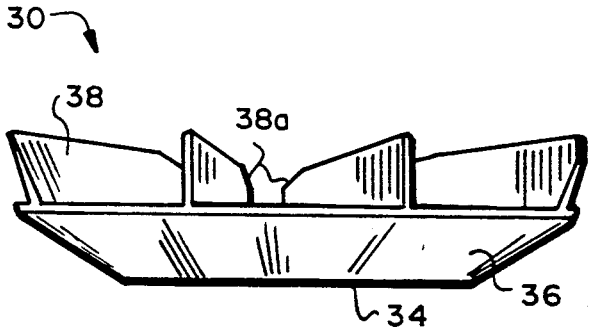
FIG. 2A is a side view of the disperser shown in FIG. 1.
Figure 2B:
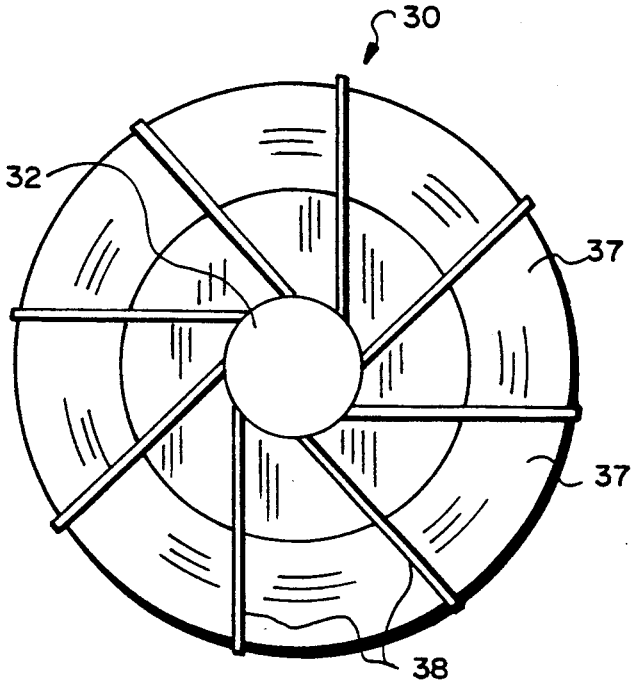
FIG. 2B is a top plan view of the disperser.
Figure 2C:
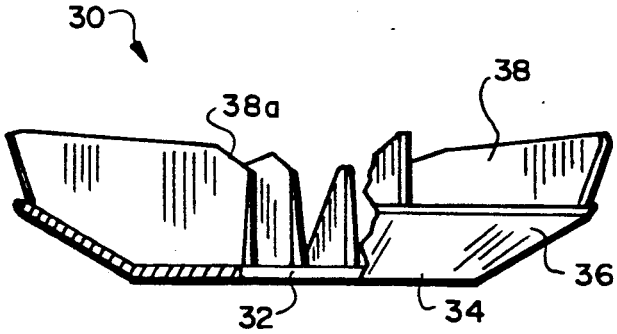
FIG. 2C is a partial section of the disperser.

Referring now to FIGS. 2A–2C, various features of the disperser 30 are shown in enlarged detail. For consistency and clarity, elements shown in FIGS. 2A–2C and 3 which correspond with elements of prior figures are designated by like reference numerals.

The combination of the flat inner portion 34 and the sloped outer portion 36 of the disperser 30 forms a cupped surface 37 between each pair of adjacent fins 38. The outer end of each fin 38 extends slightly beyond the edge of the sloped portion 36 to ensure that the dispersed aerosol spray is directed outward and clear of the disperser 30. The inner end of each fin 38 is substantially flush with the perimeter of the central opening 32 so that the fins 38 do not interfere with the rotation of the disperser 30. The bottom edge of each fin 38 is tapered, particularly along a portion 38*a* nearest the central opening 32. As described in detail below, such tapering tends to aid in the omnidirectional dispersion of the aerosol spray.

Also, as shown best in FIG. 2B, the fins 38 are preferably oriented along lines which do not intersect the center of the disperser 30. The advantage of such orientation is explained below.

Figure 3:
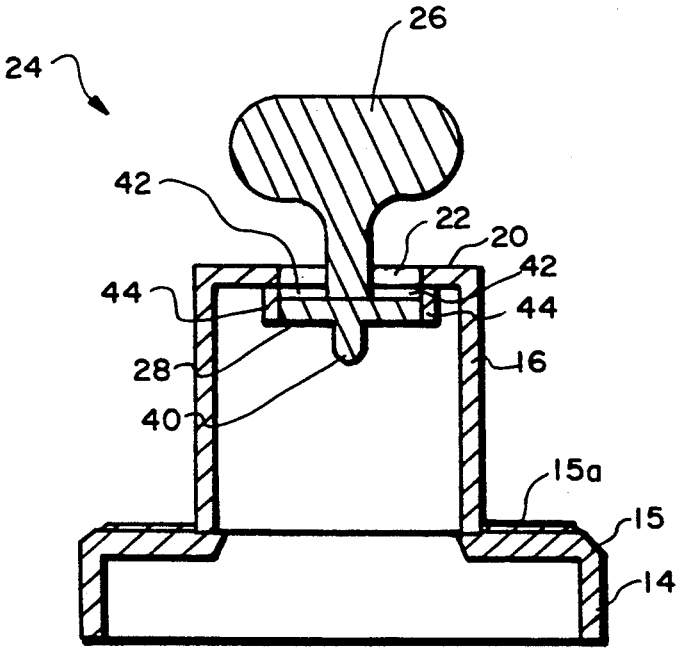
FIG. 3 is a an enlarged vertical section of the support and trigger shown in FIG. 1.

Referring now to FIG. 3, the support member 12 and trigger 24 are shown in enlarged section. The bearing surface 15 includes a circular rib or ridge 15*a*. The ridge 15*a* tends to reduce friction between the bottom of the disperser 30 and the bearing surface 15 thus enhancing the ability of the disperser 30 to rotate.

The lower portion of the trigger 24 forms a stylus 40 which (when the support member 12 is attached to an aerosol container) at rest bears slightly on the concave top surface 8*a* of the spray button 8. The stylus 40 is preferably tapered so that its tip is the narrowest part. Such tapering tends both to reduce friction between the stylus 40 and the spray button 8 as well as prevent the stylus 40 from moving laterally across the top surface 8*a* of the spray button when the trigger 24 is rotated.

Integral with the inner wall of the upper portion 16 are two trigger guides 42 and two trigger stop members 44. Each of the trigger guides 42 comprises a lip or flange which is dimensioned such that as that as the trigger 24 is rotated, extensions 28 pass laterally under the guides 42, which bear downwardly on the extensions 28. This "camming" action between the guides 42 and the extensions 28, in turn, causes the stylus 40 to bear downward on the spray button 8 and thereby release aerosol product.

The stop members 44 are arranged such that when the trigger 24 is rotated to a position of maximum bearing on the spray button 8, each lateral extension 28 is in contact with a respective stop member 44. The stop members 44 are preferably located along a line which is generally perpendicular to the slot 22 such that the trigger 24 rotates approximately 90° between its rest position and the position of maximum bearing on the spray button 8.

The operation of the disperser system 2 will now be described in detail. When a user is ready to disperse the aerosol product, he or she simply places the container 4 and attached disperser assembly in an appropriate location, grasps the flattened end 26 of the trigger 24 and twists. As the trigger 24 rotates, the stylus 40 bears down on the spray button 8 and aerosol product is released through the pinhole 10. When the trigger 24 reaches a position of maximum bearing on the spray button 8, the extensions 28 contact the stop members 42, thus inhibiting further rotation of the trigger 24 and providing tactile feedback to the user that the trigger is at its maximum position.

As spray exits the pinhole 10, it passes through the opening 18 in the support member 12 and impinges upon one of the cupped surfaces 37 between adjacent fins 38. As released spray impinges on the cupped surface 37, it is deflected generally upward and outward away from the disperser 30. Due to the cupped shaped of the surface 37, the force imparted by the spray impinging on that surface does not include a substantial vertical component. That is, most of the force produced by spray impinging on the cupped surface 37 is horizontal in a direction away from the center of the disperser 30. Advantageously, such horizontal force does not tend to lift the disperser 30 vertically, which might cause the disperser 30 to wobble or actually fly free during operation.

In addition, spray impinging on the side of a fin 38 is generally deflected outward and imparts a force to that fin. Due to the orientation of the fins 38 (i.e., they lie along lines which do not intersect the center of the disperser 30), the imparted force will generally have a component which is perpendicular to the side of the fin. It is that perpendicular component of the imparted force which urges the disperser 30 to move laterally and thus rotate about the upper portion 16 of the support member 12. In this fashion, the energy for propelling the disperser 30 is advantageously provided by the dispersing aerosol product without the need for any motor or external power supply.

Once activated, the disperser 30 rotates with sufficient speed that released aerosol spray within the cupped surfaces 37 is transported some angular distance before escaping or being forced outward. As a result, the released spray is directed in a substantially omnidirectional (e.g., 360°), uniform manner. Moreover, as additional aerosol product is released, additional force is imparted to the fins 38, thereby maintaining the rotation of the disperser 30 until all of the product is dispensed or the trigger 24 is released.

The foregoing description has been limited to a specific embodiment of this invention. It will be apparent, however, that variations and modifications may be made to the invention, with the attainment of some or all of the advantages of the invention. Therefore, it is the object of the appended claims to cover all such variations and modifications as come within the true spirit and scope of the invention.

What is claimed as new and desired to be secured by Letters Patent of the United States is:

1. An apparatus aerosol spray from a container, said apparatus comprising:

support means adapted for attachment to an aerosol container;

disperser means, rotatably disposed on said support means, for dispersing said aerosol spray in a substantially omnidirectional manner, said disperser means being shaped for rotation by said aerosol spray; and trigger means adapted for attachment to said container for controlling the release of said aerosol spray from said container.

2. The apparatus as in claim 1 wherein said support means comprises a base portion having a recess for frictionally engaging the top of the container and a top portion having a slot through which said aerosol spray may pass.

3. The apparatus as in claim 2 wherein the base portion provides a bearing surface upon which the disperser means is disposed, said bearing surface including a ridge for substantially reducing the friction between the bearing surface and the disperser means.

4. The apparatus as in claim 1 wherein the disperser means comprises a substantially annular member having a cupped top surface and a plurality of vanes extending upwardly therefrom for impingement by said aerosol spray, whereby as said aerosol spray is released from the container and impinges on said cupped top surface and vanes said spray is directed generally outward and a rotational force is imparted on the disperser means.

5. The apparatus as in claim 4 wherein the disperser means includes a bottom surface for bearing on said support means and said support means includes means for reducing friction between said bottom surface and said support means.

6. The apparatus as in claim 1 wherein said trigger means comprises a shaft having a flattened first end extending from the support means, a second end bearing on a spray button disposed on the top of said container, and at least one laterally extending portion, and said support means includes at least one trigger guide means disposed in proximity to said laterally extending portion, whereby as a user rotates the shaft a downward bearing force is imparted to the laterally extending portion by the trigger guide means which force causes the second end of the shaft to depress said spray button and release the aerosol spray.

7. The apparatus as in claim 6 wherein the support means further includes at least one stop member for engaging said laterally extending portion when the shaft is rotated to a position of maximum bearing on the spray button and inhibiting further rotation of the shaft.

8. The apparatus as in claim 1 wherein the trigger means includes means for providing tactile feedback to indicate when the trigger means is set for maximum aerosol release.

9. An aerosol disperser system comprising:

aerosol container means for holding a quantity of material to be released as an aerosol spray;

spray-propelled disperser means, rotatably disposed on the container means, for dispersing said aerosol spray in a substantially omnidirectional manner and including deflection surfaces positioned for impingement thereon by released aerosol spray and so shaped that the released aerosol spray so impinging thereon is directed outward thereby while imparting a rotational force to said disperser means; and trigger means coupled to the container means for controlling the release of said aerosol spray from said container means.

10. The system as in claim 9 wherein the disperser means is substantially annular with a cupped top surface and a plurality of vanes extending upwardly therefrom.

11. The system as in claim 9 wherein said trigger means comprises a shaft disposed in a support means, said shaft having a flattened first end extending from the support means and a second end which bears on a spray button disposed on the top of said container, whereby as a user rotates the shaft said spray button is depressed and aerosol spray is released.

12. The system as in claim 11 wherein the shaft includes at least one raised portion and the support means includes at least one stop member for engaging said raised portion when the shaft is rotated to a position of maximum bearing on the spray button and inhibiting further rotation of the shaft.

13. The system as in claim 11 wherein said support means comprises a base portion having a recess for frictionally engaging the top of the container means and a top portion having a slot through which said aerosol spray may pass.

14. The system as in claim 13 wherein the base portion provides a bearing surface upon which the disperser means is disposed, said bearing surface including a ridge for substantially reducing the friction between the bearing surface and the disperser means.

15. The system as in claim 14 wherein the disperser means includes a bottom surface for bearing on said bearing surface and said support means includes means for reducing friction between said bottom surface and said bearing surface.

16. The system as in claim 9 wherein said trigger means includes means for providing tactile feedback to indicate when the trigger means is set for maximum aerosol release.

* * * * *